United States Patent [19]

Robandt, II et al.

[11] 4,137,737

[45] Feb. 6, 1979

[54] ONE-PIECE AGITATOR WITH CLOTHES DIRECTING CAM

[75] Inventors: William F. Robandt, II, St. Joseph; Raymond W. Spiegel, Stevensville, both of Mich.

[73] Assignee: Whirlpool Corporation, Benton Harbor, Mich.

[21] Appl. No.: 840,024

[22] Filed: Oct. 6, 1977

[51] Int. Cl.[2] ..... D06F 13/00; D06F 17/10

[52] U.S. Cl. ..... 68/134

[58] Field of Search ..... 68/131–134, 68/53, 54

[56] References Cited

U.S. PATENT DOCUMENTS

| | | | |
|---|---|---|---|
| Re. 18,280 | 12/1931 | Kirby | 68/133 |
| D. 100,861 | 8/1936 | Hume | D15/57 |
| D. 105,517 | 8/1937 | Geldhof | D248/283 |
| D. 127,576 | 6/1941 | Barber | 68/54 X |
| 1,543,323 | 6/1925 | Dehle | 68/134 |
| 1,629,391 | 5/1927 | Kemp et al. | 68/134 X |
| 1,632,866 | 6/1927 | Altorfer | 68/133 |
| 1,665,959 | 4/1928 | Graham et al. | 68/133 X |
| 1,688,031 | 10/1928 | Altorfer | 68/133 |
| 1,754,626 | 4/1930 | Holzhausen | 68/134 |

FOREIGN PATENT DOCUMENTS 1020189 11/1952 France.

OTHER PUBLICATIONS

Photographs submitted by applicants in paper No. 2 of a 1964 agitator device.

*Primary Examiner*—Philip R. Coe

*Attorney, Agent, or Firm*—Hill, Gross, Simpson, Van Santen, Steadman, Chiara & Simpson

[57] ABSTRACT

An agitator for a vertical-axis automatic clothes washing machine has a plurality of circumferentially spaced apart vanes extending upwardly from a skirt adapted to overlie the bottom wall of a tub or receptacle. A corresponding plurality of lobe-like cams projects outwardly and upwardly from at or near the periphery of the skirt in the alternate spaces between the vanes. Each cam extends approximately 5 to 15° upwardly from the horizontal and is geometrically defined by two edges forming a segment of the surface of a cone co-axial with the agitator. The inner edge of each cam has the radius of the circular perimeter of the agitator skirt with which the edge is co-linear; the upper edge either has a somewhat smaller radius in a crescent-shaped configuration or has an irregular, double-lobe configuration. The upper cam edges impel the clothes upwardly as the agitator oscillates to and fro, thereby promoting a successive movement of clothes downwardly, outwardly, upwardly, inwardly, and downwardly again, within the receptacle.

6 Claims, 6 Drawing Figures

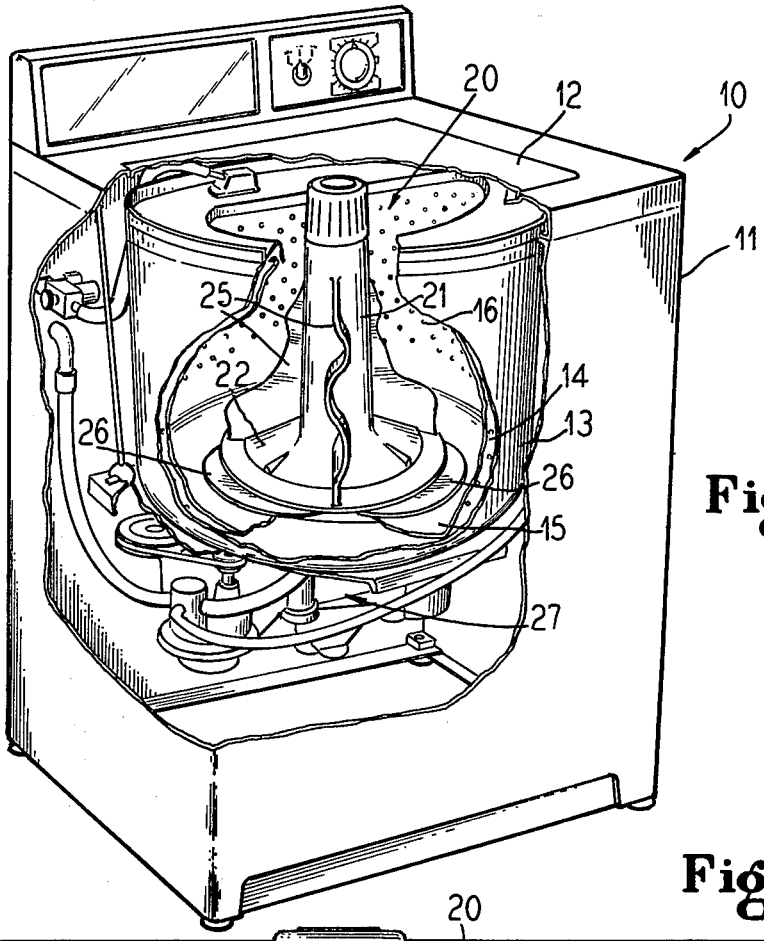
Fig. 1
Fig. 2
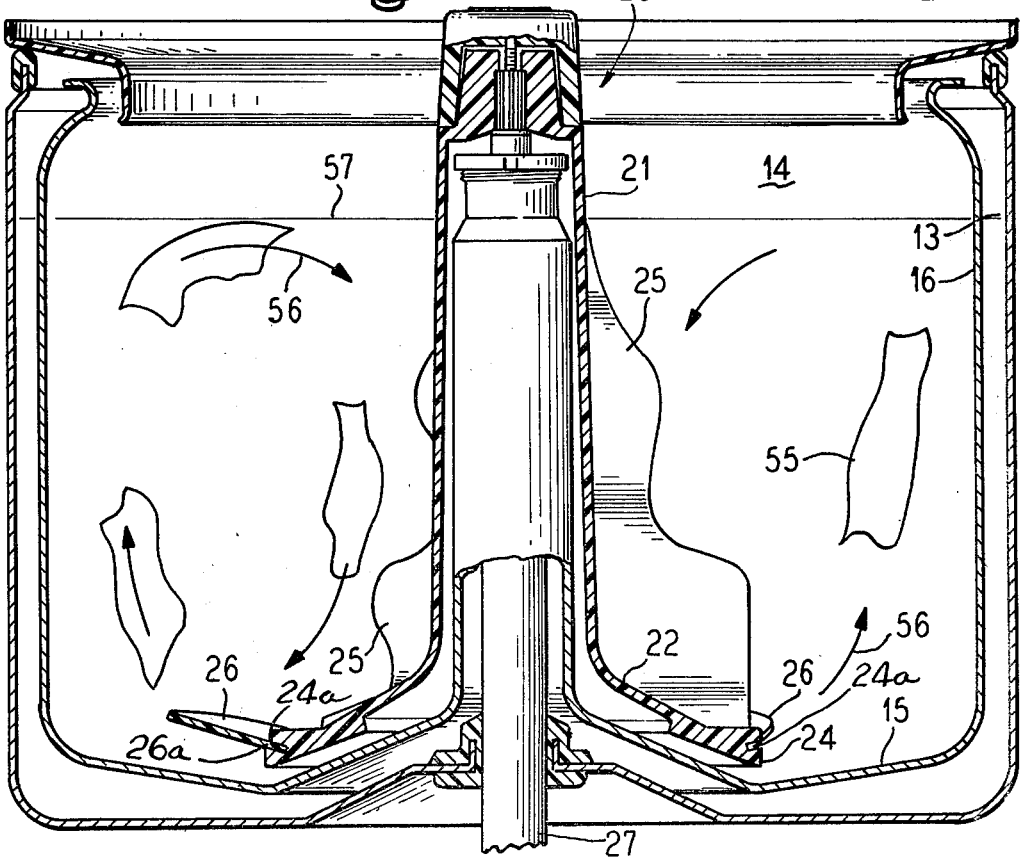

ONE-PIECE AGITATOR WITH CLOTHES DIRECTING CAM

BACKGROUND OF THE INVENTION

1. Field of the Invention

The present invention relates to automatic washing machines employing vertical axis agitators to provide a generally toroidal rollover motion to clothes and wash fluid within the machine.

2. The Prior Art

When an ordinary washing basket is heavily loaded with clothes, the heavy load tends to crowd a conventional agitator and often affects adversely achievement of a full rollover action. Maximum rollover is desired to expose all portions of the load to adequate scrubbing action.

An efficient movement pattern for clothes within an automatic washing machine having a vertical axis agitator is one of toroidal rollover, for example, as accomplished by a so-called double acting auger agitator of the type disclosed and claimed in a series of patents assigned to the same assignee as the present invention, i.e., U.S. Pat. Nos. 3,987,508, 3,987,651, 3,987,652 and 4,048,820. Such rollover action is accomplished by providing a means for moving clothes down the agitator center post, radially outwardly from the oscillating agitator vanes, upwardly along the wall of the wash receptacle, and inwardly to the center post at the surface of the wash fluid, forming a toroidal pattern in the wash zone and within the washing liquid.

U.S. Pat. Nos. 1,543,323, 1,688,031 and 1,754,626 disclose automatic washing machines having raised rims on oscillating circular skirts. U.S. Pat. Nos. 1,629,391 and Re 18,280 show non-oscillating flow deflectors in the bottom of wash receptacles of automatic washing machines. U.S. Pat. Nos. 1,632,866, 2,665,959, Des. 100,861, Des. 105,517, and Des. 127,576, and French Pat. No. 1,020,189 show agitators having generally circular skirts with upward convolutions in the circumferential direction thereon.

A prior art agitator device had a skirt portion and generally upright vanes having a wavy configuration throughout their vertical extent. Attached to a chordal section of the agitator skirt between each of the upright vanes was a flat or planar, crescent-shaped cam. Oscillation of the agitator and the crescent-shaped cams thereon in a body of water produced some additional agitation, the added agitation being directed generally in a vertical direction.

SUMMARY OF THE INVENTION

In view of the energy crisis and the increasing recognition of water shortages, it is likely that larger clothes loads are going to be laundered in washers but with proportionally less water than heretofore provided. The present invention is especially suited to roll over a larger quantity of clothes charged into a washing zone of a laundry machine.

A one-piece agitator having an upstanding center post and a lower skirt portion is mounted inside a wash basket or receptacle for rotational oscillation about a vertical axis. A plurality of vanes is attached to the center post and the skirt, extending generally radially and vertically. A corresponding plurality of lobe-like cams is attached to the agitator skirt perimeter, with opposite ends of each cam spaced closely circumferentially adjacent one of the vertical vanes. The cams extend about 5 to 15° above the horizontal on the surface of a cone co-axial with the agitator center post and skirt. The perimeter of the skirt and the lower edges of the cams have a common radius, while upper edges of the cams have a slightly smaller radius. The upper edges of the cams impel the clothes generally outwardly and upwardly.

THE DRAWINGS

FIG. 1 is a perspective view of a washing machine with portions of the cabinet cut away to show the wash receptacle, agitator, and other internal parts thereof.

FIG. 2 is a sectional view, taken generally on line II—II of FIG. 3, through the agitator, basket, and the drum of the washing machine and depicting the desired toroidal rollover of articles being washed.

THE PREFERRED EMBODIMENTS

Figure 3:
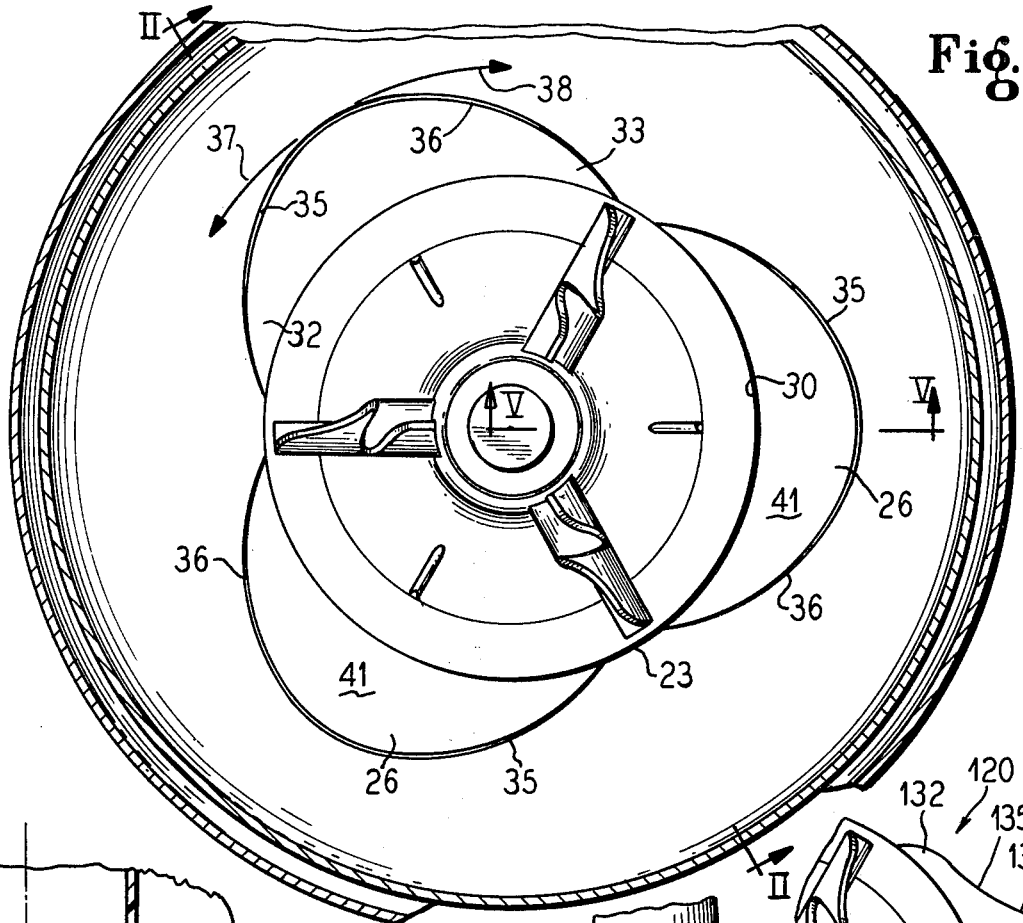
FIG. 3 is a top plan view of an agitator with camming surfaces thereon and portions of the surrounding basket and tub.

A washing machine 10 of the automatic, vertical axis type, shown generally in FIG. 1, comprises a cabinet 11 having a hinged lid 12 for permitting access to the interior of the machine 10. Within the cabinet 11 is an imperforate fluid retaining tub 13 and a perforate washing receptacle or basket 14 mounted co-axially therewithin. The basket 14 has a lower wall 15 and a side wall 16, the wall 16 being generally cylindrical.

The agitator 20 of the present invention is mounted co-axially within the tub 13 and the basket 14. The agitator 20 comprises an upstanding center post or barrel portion 21 and a lower, generally conical skirt portion 22 having a circular outer periphery 23 having a lowermost edge 24 and an intermediate outwardly facing angularly inclined recess **24*a*. A plurality of axially-wavy fluid handling and scrubbing vanes 25 is formed integrally with the outer wall of the center post 21 and the upper surface of the skirt 23, each vane extending in radial and vertical relation thereto. A corresponding plurality of lobe-like cams 26 is affixed to the peripheral rim 23 of the agitator skirt 22 between adjacent pairs of agitator vanes 25 and upwardly of the skirt edge 24 for example, by fitting the inner edge 26*a* of each cam 26 with a corresponding portion of the recess 24*a***.

Driving means 27 drive the agitator 20 including the vanes 25 and cams 26 thereon in repetitive rotational oscillations within the clothes washing receptacle or basket 14. The oscillatory arc of the agitator 20 is greater than 180° where three vanes 25 are provided. Where the oscillatory arc effected by the drive means 27 is smaller, a greater number of vertical vanes 25 and cams 26 would be used to insure proper clothes circulation and scrubbing.

The indiviual ones of the cams 26 in a first embodiment are geometrically defined by edges 30 and 31, the edge lines forming or defining a portion of the area of a cone co-axial with the agitator 20. That is, if the surfaces of the cams 26 were projected radially inwardly, there would be defined a cone surface having an axis co-axial with that of the agitator. Thus, upon oscillation of the agitator, the cams 26 merely cut through the laundry liquid without materially increasing required torque from the drive means 27. An inner one 30 of the edges has the same radius as the periphery 23 of the skirt 22. Thus, the lower edge 30 of each lifting cam 26 is co-linear with such circular periphery 23. The second free upper or outer edge 31 of each lifting cam 26 is defined by a somewhat smaller radius than that of the inner edge 30. Each outer edge 31 joins the periphery 23 of the skirt 22 at cusped cam ends 32, 33 formed at the periphery 23 of the skirt 22. Portions of the upper edge 31 on either half of the cam provide alternating leading and trailing edges 35, 36 depending on the direction of oscillation or rotation 37, 38 of the agitator 20, as in FIG. 2. Upon counterclockwise rotation or oscillation 37, a forward portion 35 of the edge 31 is a leading edge, and the opposite portion 36 is a trailing edge. Upon reverse rotation 38, the functions of the edge portions 35, 36 also reverse. Each free edge 31 in the first embodiment joins the periphery 23 of the skirt 22 closely circumferentially adjacent each of the vanes 25. That is, as shown in FIG. 2, each end 32, 33 of each cam 26 terminates at the periphery 23 of the skirt 22 at a point spaced slightly before the vane 25.

Figure 5:
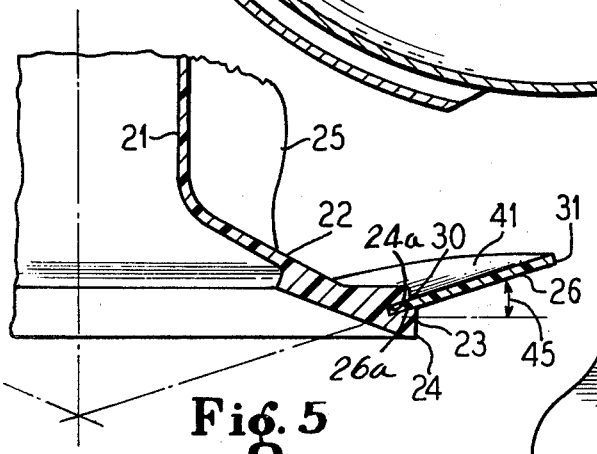
FIG. 5 is a detail sectional view on line V—V of FIG. 3.

In a second embodiment, shown in FIG. 5, an agitator 120 is formed with double-lobe cams 126 which are generally similar to the cams 26 of the first embodiment, except that the outer edge 131 follows an irregular path as shown in FIG. 5 including forming somewhat abrupt end portions 132, 133 joining the periphery 123 of the skirt 122 at about a 45° angle. The center portion of the outer edge 131 forms a spaced pair of lobes 131A and 131B. Intermediate portions 131C between the ends 132 and 133 and the respective lobes 131A and 131B are reversely curved as shown in the figure. It has been found that the double-lobe cams of FIG. 5 have somewhat different washability characteristics than the crescent-shaped cam as in FIG. 2. Apparently the greater slope of the outer edge portion 131C and the double-lobe embodiment is preferred for heavier fabrics, while the smoother curve of the embodiment of FIG. 2 is preferred for lighter fabrics.

Figure 4:
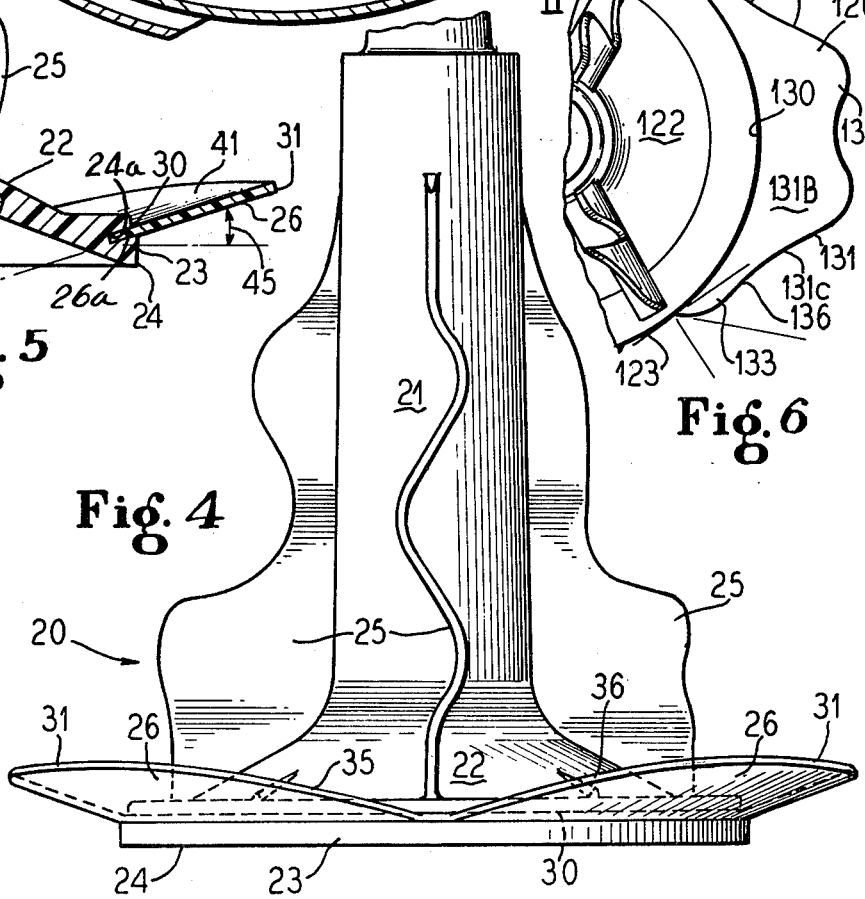
FIG. 4 is a side elevation view of the agitator of the present invention.

In some embodiments, the upstanding vanes 25 appear to cooperate with the upwardly and outwardly extending cams 26 to impel the wash water and fabric articles therein outwardly over the surface of the skirt and upwardly in the outer part of the basket 14. The lower portions of the vanes 25 are wavy in the axial direction and urge the water thereon to flow radially thereof. The radial urging of the wash liquid and articles of clothing is assisted by the leading edges of the cams 26 or 126, which edges also impart somewhat of an upward movement to fabric articles coming into contact therewith. An inclination angle 45, as in FIG. 4, of from 5 to 15° between an upper surface 41 of the cam 26 or 126 and a horizontal line radial of the agitator has been found to be effective in providing such upward and outward urging. Such angle of the upper edge 31 or 131 provides a good lifting movement without increasing torque requirements by any excessive amount. A clearance of several inches, about 5 inches or 13 cm, between the cams 26 and the side walls 16 of the basket 14 has been found to give a good, sweeping coverage for the bottom of the washing basket 14 above the lower wall 15 thereof, while avoiding pinching of fabrics between the walls of the somewhat flatly inclined cams 26 and the basket lower wall 15 or the side wall 16.

Figure 6:
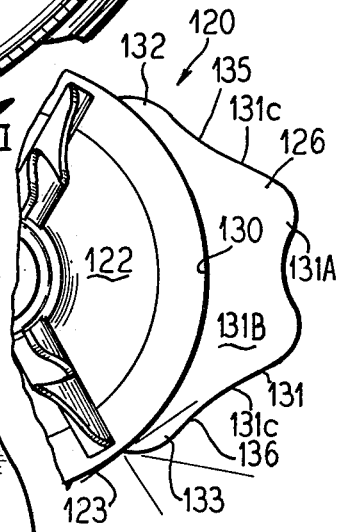
FIG. 6 is a top plan view of a second embodiment of a cam in accordance with the present invention.

In operation, articles of fabrics or clothing 55 are placed within the washing basket 14 about the agitator 20, and the basket 14 and the tub 13 are filled with wash fluid. As shown by the arrows 56 in FIG. 6, the articles 55 are urged through a toroidal pattern of movement within the wash fluid, indicated by a water level 57. As the agitator 20 oscillates in to and fro motions 37, 38, the fabrics or clothing articles 55 are impelled outwardly at the bottom of the clothes basket 14 by the vanes 25 and the upper edges 31 or 131 of the cams 26 or 126 along the leading edge portions 35, 36 or 135, 136 thereof. The outward and upward displacement of the articles 55 in the lower portion of the basket 14 causes articles within the basket 14 to move downwardly along the center post 21 of the agitator 20. Even when the load of clothing articles 55 within the basket 14 is heavy, i.e., the wash load/water ratio is large, the positive lifting action of the cams 26 or 126 assures positive rollover of the load in the machine.

Although various minor modifications may be suggested by those versed in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. An agitator for an automatic clothes washing machine, the agitator comprising:

a unitary, co-axial skirt having a circular outer periphery and a center post extending upwardly therefrom;

an outwardly facing angularly inclined recess formed in said outer periphery;

a plurality of agitator vanes extending generally radially of the center post and upwardly of the skirt; and a corresponding plurality of lobe-like cams affixed to the periphery of the skirt, wherein each of said cams is located between a pair of vanes, the cams form portions of the surface of a cone co-axial with the agitator, and each said cam has opposite ends each of which terminates closely circumferentially adjacent one of said vanes, each of said lobe-like cams having an outer edge and an inner edge on said conical surface, the inner edge of each said cam being co-linear with the circular outer periphery of said skirt and fitting in said recess and each said cam constructed and arranged to be disposed at an inclination angle of from 5° to 15° between an upper surface of the cam and a horizontal line radial of the agitator, whereby oscillation of the agitator sweeps the vanes and cams through a laundry liquid about the agitator, the vanes urging clothes in the liquid outwardly and the cams urging them upwardly.

2. An agitator as defined in claim 1, wherein each of the lobe-like cams has a crescent-shape with opposite ends formed as cusps for smooth, even upward camming of said clothes in the machine upon oscillation of the agitator.

3. An agitator for an automatic clothes washing machine, the agitator comprising:

a unitary, co-axial skirt having a circular outer periphery and a center post extending upwardly therefrom;

a plurality of agitator vanes extending generally radially of the center post and upwardly of the skirt; and a corresponding plurality of lobe-like cams affixed to the periphery of the skirt; wherein each of said cams is located between a pair of vanes, the cams form portions of the surface of a cone co-axial with the agitator, and each said cam has opposite ends each of which terminates closely circumferentially adjacent one of said vanes, each of the lobe-like cams has an outer edge on said conical surface which has an undulating form including a pair of small circumferentially spaced outer lobes separated by an inward recess, whereby oscillation of the agitator sweeps the vanes and cams through a laundry liquid about the agitator, the vanes urging clothes in the liquid outwardly and the cams urging them upwardly.

4. An agitator as defined in claim 3, wherein the outer and inner edges of each cam join together with an angle between them of approximately 45°.

5. An agitator as defined in claim 1 and further characterized by the outer and inner edges of each said lobe-like cam being of different radii with the outer edge being of a somewhat smaller radius.

6. An agitator as defined in claim 1 and being further characterized by the outer edge of each said cam being undulated to form two lobes separated by a recess.

* * * * *